US008238590B2

(12) United States Patent
Burge

(10) Patent No.: US 8,238,590 B2
(45) Date of Patent: Aug. 7, 2012

(54) AUTOMATED AUDIO SOURCE CONTROL BASED ON AUDIO OUTPUT DEVICE PLACEMENT DETECTION

(75) Inventor: Benjamin Douglass Burge, Shaker Heights, OH (US)

(73) Assignee: Bose Corporation, Framingham, MA (US)

( * ) Notice: Subject to any disclaimer, the term of this patent is extended or adjusted under 35 U.S.C. 154(b) by 1058 days.

(21) Appl. No.: 12/044,448

(22) Filed: Mar. 7, 2008

(65) Prior Publication Data

US 2009/0226013 A1 Sep. 10, 2009

(51) Int. Cl.
*H04R 5/033* (2006.01)
*H04R 5/00* (2006.01)
*H04R 1/10* (2006.01)

(52) U.S. Cl. ..... 381/309; 381/74; 381/370

(58) Field of Classification Search ..... 381/309, 381/150, 74, 311, 370, 380, 384
See application file for complete search history.

(56) References Cited

U.S. PATENT DOCUMENTS 4,955,729 A * 9/1990 Marx ..... 381/322
5,144,678 A * 9/1992 Lenz ..... 381/384
5,577,511 A 11/1996 Killion
5,708,725 A * 1/1998 Ito ..... 381/370
6,118,878 A 9/2000 Jones
6,163,610 A 12/2000 Bartlett et al.
6,532,294 B1 3/2003 Rudell
6,542,436 B1 4/2003 Myllyla
6,567,524 B1 5/2003 Svean et al.
6,639,987 B2 10/2003 McIntosh
6,687,377 B2 2/2004 Voix et al.
6,704,428 B1 3/2004 Wurtz
6,763,116 B2 7/2004 Barthel et al.
7,039,195 B1 5/2006 Svean et al.
7,406,179 B2 * 7/2008 Ryan ..... 381/312
7,418,103 B2 8/2008 Sargaison
7,433,481 B2 10/2008 Armstrong et al.
7,450,730 B2 11/2008 Berg et al.
7,522,739 B2 * 4/2009 Rass et al. ..... 381/323

(Continued)

FOREIGN PATENT DOCUMENTS

DE 102007013719 A1 9/2008

(Continued)

OTHER PUBLICATIONS

EP Examination report dated Mar. 15, 2011 for EP Appln. No. 09719786.7.

(Continued)

*Primary Examiner* — Edgardo San Martin
(74) *Attorney, Agent, or Firm* — Bose Corporation

(57) ABSTRACT

An apparatus and method for automatically remotely controlling an audio source providing the apparatus with audio for being audibly output to a user of the apparatus entails monitoring various sensors to determine whether or not one or more ear couplings of the apparatus are positioned in close proximity to one or both of the user's ears to determine whether the user is listening to the audibly output audio with either one or both ears, or is not listening at all. In response to changes in whether the user is listening with either one or both ears, or whether the user is listening at all, the audio source is automatically signaled with one or more commands to cease or resume providing the audio to the apparatus, perform or cease performing various alterations on the audio before providing it to the apparatus, etc.

22 Claims, 6 Drawing Sheets

U.S. PATENT DOCUMENTS

| | | | | |
|---|---|---|---|---|
| 7,639,827 | B2 | 12/2009 | Bachler | |
| 7,783,057 | B2 * | 8/2010 | Park | 381/74 |
| 7,925,029 | B2 * | 4/2011 | Hollemans et al. | 381/74 |
| 2002/0076057 | A1 | 6/2002 | Voix | |
| 2003/0161479 | A1 | 8/2003 | Yang et al. | |
| 2006/0013079 | A1 | 1/2006 | Rekimoto | |
| 2006/0029234 | A1 | 2/2006 | Sargaison | |
| 2006/0045304 | A1 | 3/2006 | Lee et al. | |
| 2006/0215847 | A1 | 9/2006 | Hollemans et al. | |
| 2007/0076897 | A1 | 4/2007 | Philipp | |
| 2007/0160255 | A1 * | 7/2007 | Cheng et al. | 381/384 |
| 2007/0274530 | A1 | 11/2007 | Buil et al. | |
| 2007/0297618 | A1 | 12/2007 | Nurmi et al. | |
| 2007/0297634 | A1 * | 12/2007 | Hansson | 381/384 |
| 2008/0192942 | A1 | 8/2008 | Yamkovoy et al. | |
| 2008/0260176 | A1 * | 10/2008 | Hollemans et al. | 381/74 |
| 2009/0154720 | A1 * | 6/2009 | Oki | 381/74 |
| 2009/0268936 | A1 * | 10/2009 | Goldberg et al. | 381/384 |
| 2010/0054518 | A1 | 3/2010 | Goldin | |
| 2010/0128887 | A1 * | 5/2010 | Lee et al. | 381/74 |
| 2010/0183183 | A1 | 7/2010 | Bae et al. | |
| 2010/0246847 | A1 | 9/2010 | Johnson, Jr. et al. | |
| 2011/0144779 | A1 * | 6/2011 | Janse et al. | 700/94 |
| 2011/0293129 | A1 | 12/2011 | Dillen et al. | |
| 2012/0002822 | A1 | 1/2012 | Peissig et al. | |

FOREIGN PATENT DOCUMENTS

| | | | |
|---|---|---|---|
| EP | 0363056 | A2 | 4/1990 |
| EP | 1059635 | A2 | 12/2000 |
| EP | 1465454 | A2 | 10/2004 |
| JP | 07298383 | A * | 11/1995 |
| WO | 2007/049255 | A2 | 5/2007 |
| WO | 2007/110807 | A2 | 10/2007 |
| WO | 2007/141769 | A2 | 12/2007 |
| WO | 2008096125 | A2 | 8/2008 |

OTHER PUBLICATIONS

International Search Report and Written Opinion dated Jun. 16, 2009 for PCT/US2009/035826.

International Search Report and Written Opinion dated Aug. 10, 2010 for PCT/US2010/029031.

International Preliminary Report on Patentability dated Jun. 1, 2010 for PCT/US2009/035826.

Invitation To Pay Additional Fees dated May 26, 2010 for PCT/US10/029031.

* cited by examiner

AUTOMATED AUDIO SOURCE CONTROL BASED ON AUDIO OUTPUT DEVICE PLACEMENT DETECTION

FIELD

This description relates to audio output devices worn on the head of listeners and the remote control of audio sources in response to head positioning.

BACKGROUND

It has become commonplace for those who listen to electronically output audio to employ headphones or headsets to do so, and it has become commonplace to provide users of those headphones and headsets with at least two audio channels of audio through those headphones or headsets, such as stereo left and right channels separately provided to each ear. Further, recent developments in digital signal processing (DSP) technology have also made possible the introduction of various forms of surround sound involving the output of multiple audio channels and the introduction of various forms of noise cancellation to those headphones and headsets to mask ambient noises.

Yet, despite these many advances in audio output functionality, user controls provided to control the operation of those headphones and headsets remain cumbersome. More specifically, it has become commonplace to provide various manually-operable controls on headphones and headsets, themselves, to turn them on or off, and to control various aspects of audio output. However, the need to keep headphones and headsets relatively small and light so that they are comfortable to use has often resulted in manually-operable controls that are too small for comfortable operation or that are hard to locate solely by the touch of a listener's fingers.

This less than user-friendly nature of these controls has often lead to users of those headphones and headsets simply removing one or both earcups or earbuds (earbuds otherwise being known as "in-ear" headphones) from their ears without bothering to either turn off those headphones or headsets or otherwise operate one or more of the controls to adjust or cease audio output. This often means that users choose to allow batteries within headphones and headsets to be drained, because finding the on/off switch is simply too cumbersome. Similarly, this often means that users of headphones or headsets where one or the other of the pair of earcups or earbuds are movable away from one or the other of the user's ears for one-ear operation are often operated by those users in a manner where they choose to forego listening to one or more audio channels that were directed to the ear from which the earcup or earbud has been moved, because finding a control (or taking other action) that might redirect those unheard audio channels to the other ear is similarly too cumbersome.

Further, little effort has been made by purveyors of audio sources providing the audio to be output by those headphones and headsets to provide some way for a user of those headphones or headsets to quickly or easily control the on/off state of those audio sources or to control various aspects of how those audio sources interact with those headphones or headsets. More specifically, little effort has been made to provide a way to quickly or easily control the provision of audio channels to one ear or the other in instances where a user switches between using both earcups or earbuds of those headphones and headsets to using only one or the other the two earcups or earbuds. It is not uncommon for those listening to music amidst a busy environment to take one or both earbuds of a pair of earbuds out of their ears to answer a telephone call or momentarily concentrate their attention on a given task. It is also not uncommon for radio operators, airplane pilots and disk jockeys to momentarily move or turn an earcup of a pair of headphones or of a headset away from one ear to give part of their attention to a sound in their local environment or to engage in a momentary conversation with another person beside them.

SUMMARY

An apparatus and method for automatically remotely controlling an audio source providing the apparatus with audio for being audibly output to a user of the apparatus entails monitoring various sensors to determine whether or not one or more ear couplings of the apparatus are positioned in close proximity to one or both of the user's ears to determine whether the user is listening to the audibly output audio with either one or both ears, or is not listening at all. In response to changes in whether the user is listening with either one or both ears, or whether the user is listening at all, the audio source is automatically signaled with one or more commands to cease or resume providing the audio to the apparatus, perform or cease performing various alterations on the audio before providing it to the apparatus, etc.

In one aspect, an apparatus is structured to be worn on the head of a user to audibly output a piece of audio conveyed to the apparatus by an audio source. The apparatus comprises a first acoustic driver, a first ear coupling structured to be positioned in close proximity to a first ear of the user to position the first acoustic driver to audibly output a first portion of the piece of audio to the first ear, a first sensor positioned relative to the first ear coupling to detect an indication of whether or not the first ear coupling is positioned in close proximity to the first ear, and a circuit coupled to the first sensor to monitor the first sensor and structured to control the audible output of the first portion of the piece of audio by the first acoustic driver, wherein the circuit is structured to signal the audio source with a command in response to receiving from the sensor an indication of the first ear coupling not being positioned in close proximity to the first ear.

Implementations may include, and are not limited to, one or more of the following features. The apparatus may additionally comprise a second acoustic driver to audibly output a second portion of the piece of audio to a second ear of the user, a second ear coupling and a second sensor to detect whether or not the second ear coupling is in close proximity to the second ear. The apparatus may signal the audio source with one or more commands (e.g., commands to pause, stop, play, resume playing, cease pausing, rewind an entire recording, rewind a portion of a recording, advance to an upcoming portion of a recording, turn on or off, combine and/or reroute audio channels, resume or cease providing surround sound functionality, etc.) in response to determining with one or both of the first and second sensors that both the first and second ear couplings are in close proximity to corresponding ones of the first and second ears, that only one or the other of the first and second ear couplings is in such proximity, or that neither of the first and second ear couplings is in such proximity. The apparatus may signal the audio source with one or more commands in response to the passage of one or more predetermined periods of time, especially as time continues to elapse since a determination was made that one or both of the ear couplings is not in close proximity to one or both of the user's ears and no change such a situation has been detected.

In one aspect, a method entails automatically remotely controlling an audio source conveying a piece of audio to an apparatus structured to be worn on the head of a user. The method comprises monitoring a first sensor for indications of whether or not a first ear coupling is positioned in close proximity to a first ear of the user such that a first acoustic driver is positioned to audibly output a first portion of the piece of audio to the first ear, and signaling the audio source with a command in response to receiving from the first sensor an indication of the first ear coupling not being positioned in close proximity to the first ear.

Implementations may include, and are not limited to, one or more of the following features. The method may additionally comprise monitoring a second sensor for indications of whether or not a second ear coupling is positioned in close proximity to a second ear of the user such that a second acoustic driver is positioned to audibly output a second portion of the piece of audio to the second ear. The method may additionally comprise determining with one or both of the first and second sensors that both the first and second ear couplings are in close proximity to corresponding ones of the first and second ears, that only one or the other of the first and second ear couplings is in such proximity, or that neither of the first and second ear couplings is in such proximity. The method may additionally comprise signaling the audio source with one or more commands (e.g., commands to pause, stop, play, resume playing, cease pausing, rewind an entire recording, rewind a portion of a recording, advance to an upcoming portion of a recording, turn on or off, combine and/or reroute audio channels, resume or cease providing surround sound functionality, etc.) in response to one or more of those determinations. The method may additionally comprise signaling the audio source with one or more commands in response to the passage of one or more predetermined periods of time since one or more of those determinations.

DESCRIPTION

Figure 1:
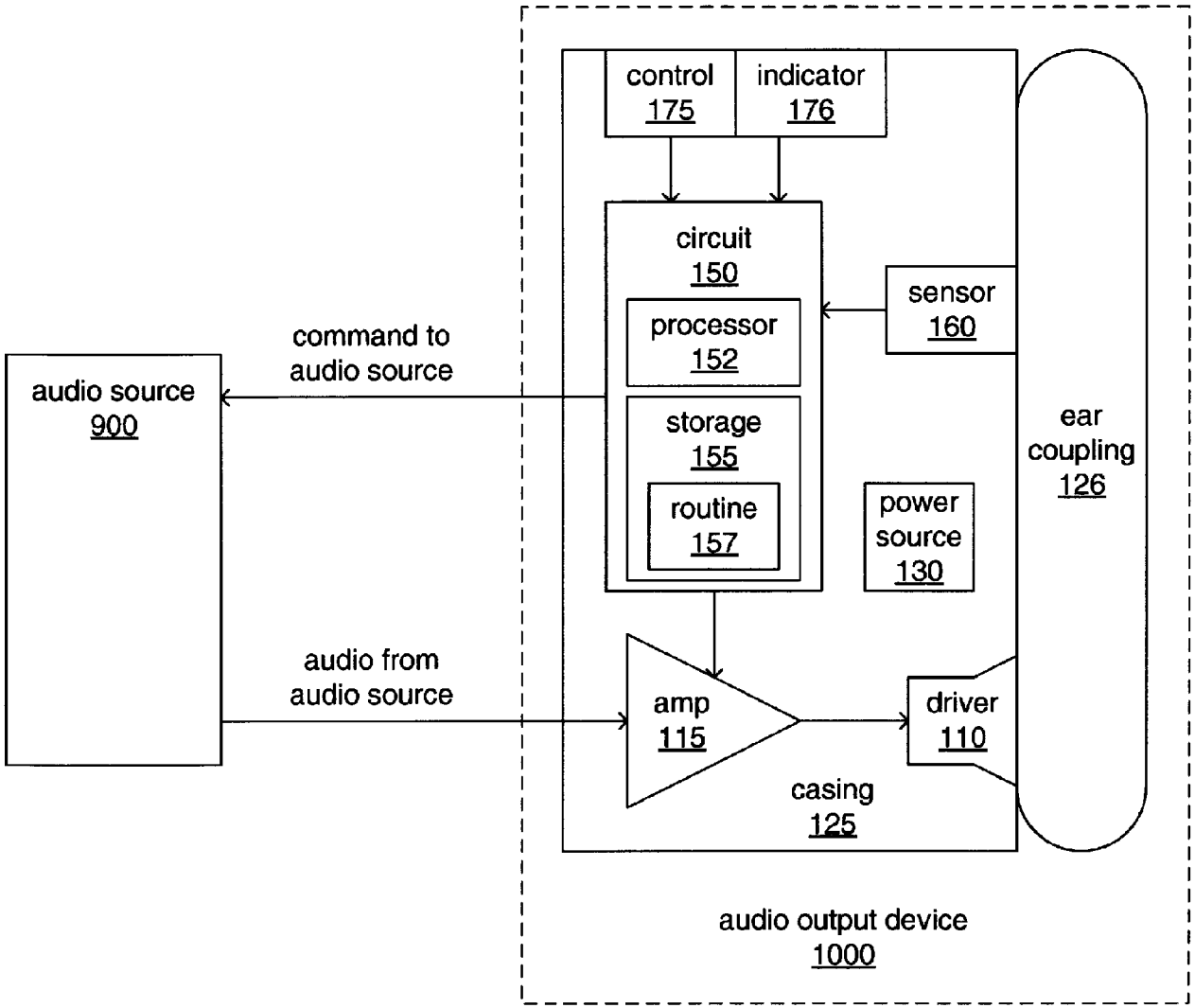
FIG. 1 is a block diagram of an audio output device.

FIG. 1 is a block diagram depicting a possible internal architecture of an audio output device 1000 for selectively audibly outputting audio to an ear of a user, and/or for selectively transmitting commands to an audio source 900 that may be supplying that audio. The audio output device 1000 incorporates a casing 125 carrying at least an acoustic driver 110, an ear coupling 126 and a sensor 160. The casing 125 may further carry one or more of an amplifier 115, a power source 130, a circuit 150, a control 175 and an indicator 176. The ear coupling 126 may take any of a variety of forms meant to guide the acoustic driver 110 into close proximity to an ear, including and not limited to, a flexible skirt meant to surround an earlobe, a flexible pad meant to be positioned to overlie an ear, or a tubular projection meant to be inserted into an ear canal. With the ear coupling 126 thereby positioned around, against or at least partially within an ear, the acoustic driver 110 is able to audibly output audio into the ear.

As previously stated, the audio that is output by the acoustic driver 110 may be provided to the audio output device 1000 by the audio source 900. The audio source 900 may be any of a number of devices capable of providing audio to the audio output device 1000, including and not limited to, a cell phone, a digital music file player (e.g., MP3 file player), a television, and an audio media player (e.g., a CD player). Additionally and/or alternatively, the audio that is output by the acoustic driver 110 may be audio generated by the audio output device 1000, perhaps by the circuit 150, as part of performing a noise reduction function in which the audio that is output by the acoustic driver is meant to counteract a sound.

The acoustic driver 110 may based on any of a variety of technologies, including and not limited to, a piezo-electric element, an electromagnetic speaker, and an electrostatic speaker. Depending on the nature and the source of the audio output by the acoustic driver 110, the amplifier 115 may or may not be incorporated into the audio output device 1000 to amplify that audio and drive the acoustic driver 110 with that audio. By way of example, the amplifier 115 may be incorporated into the audio output device 1000 where a signal conveying the audio from an audio source is an optical or radio frequency signal that must be decoded and/or converted into an analog electrical signal to drive the acoustic driver 110.

The power source 130 provides electrical power to the amplifier 115 and/or the circuit 150. The power source 130 may take an of a variety of forms and be based on any of a variety of technologies, including and not limited to, a battery, AC mains (or a derivative thereof), and a super capacitor. In some embodiments, the power source 130 is a battery that is rechargeable through a connection to another power source (not shown) coupled to AC mains. In other embodiments, the power source 130 is a super capacitor supported by additional circuitry (not shown) that trickle-charges the power source 130 by drawing electrical energy from an electrical signal conveying the audio from the audio source 900 to the audio output device 1000. Still other forms of power sources will readily occur to those skilled in the art.

The circuit 150 is coupled to the sensor 160 supplying an input that the circuit 150 employs in determining whether or not the ear coupling 126 is positioned in close proximity to an ear of the user such that the assumption can be made that the user is listening to the acoustic driver 110. The sensor 160 may be any of a number of devices or combinations of devices based on any of a variety of technologies. In some embodiments, the sensor 160 may be one or more devices incorporated into the ear coupling 126 to detect the physical proximity or contact of the ear coupling 126 to a portion of a user's body. In some embodiments, the sensor 160 may be positioned relative to the ear coupling 126 to detect indications of whether or not the ear coupling 126 is positioned such that the acoustic driver 110 is directed towards the ambient environment surrounding the audio output device 1000 rather than being directed towards some portion of the user's body. Specific implementations of the sensor 160 include, and are not limited to, a photo sensor to detect ambient light and/or to detect light of a wavelength indicative of close proximity to an ear, a microphone to detect ambient sounds and/or to detect a sound indicative of close proximity to an ear, a pressure sensor within or physically coupled to the ear coupling 126 to detect a physical contact of something with the ear coupling 126 that may be indicative of close proximity to some portion of the user's body, or any of a variety of sensors capable of detecting electrical impulses indicative of close proximity to some portion of the user's body.

Regardless of how the circuit 150 determines whether or not the user is listening, the circuit 150 may respond to determining that the user is or is not listening in any of a variety of ways. In some embodiments, the circuit 150 responds to the determination that the user is not listening by turning off the amplifier 115, at least until the circuit 150 later determines that the user is once again listening. In other embodiments, the circuit 150 responds to the determination that the user is not listening by signaling the audio source 900 with a command that in some way causes the audio source 900 to cease providing audio to the audio output device 1000, at least until the circuit 150 later determines that the user is once again listening.

The circuit 150 may signal the audio source 900 with any of a wide variety of commands or sequences of commands chosen to cause the audio source 900 to at least momentarily cease providing audio to the audio output device 1000 in response to a determination that the user is not listening. In some embodiments, the circuit 150 may simply signal the audio source 900 with a "stop" command or a "pause" command to cause the audio source 900 to cease providing audio. This may be deemed appropriate where the audio source 900 is engaged in playing an audio recording, such as where the audio source 900 is a compact disc player or digital music file player (e.g., MP3 player). It may be deemed preferable for the circuit 150 to at least initially signal the audio source 900 with a "pause" command and later signal the audio source to cease obeying the "pause" command in response to a determination that the user is once again listening. In this way, the user, while listening to audio provided by the audio source 900 through the acoustic driver 110 of the audio output device 1000, may simply remove the audio output device 1000 such that the ear coupling 126 is no longer in close proximity to the user's ear, and the circuit 150 will automatically respond by signaling the audio source 900 to pause its audio output. Then, when the user once again puts the audio output device 1000 in place such that the ear coupling 126 is once again in close proximity to the user's ear, the circuit 150 will automatically respond by signaling the audio source 900 to resume its output.

In some embodiments, the initial "pause" command signaled to the audio source 900 in response to a determination that the user is not listening may be followed by one or more subsequent commands after at least one predetermined interval of time has passed from when the determination was made that the user is not listening and there has not yet been a determination made that the user is once again listening. In one variation, the initial "pause" command may be followed by a "stop" command and/or an "off" command to the audio source 900 based on a presumption that some considerable length of time is expected to pass before the user will once again be listening, and it is desirable to operate the audio source 900 to conserve power. As those skilled in the art will recognize, some possible forms of the audio source 900 consume more power while obeying a "pause" command than while obeying a "stop" command.

In another variation, the initial "pause" command may be followed by a subsequent "skip back" or similar command in response to a predetermined period of time having elapsed since the user was determined to have stopped listening. This may be deemed desirable where the audio source 900 is outputting a sequence or list of audio recordings, and the user was determined to have stopped listening in the middle of the playback of one of those recordings. This may be done on the presumption that after a relatively longer period of time of not listening to the playback of that recording, the user will likely prefer to resume listening to that recording from the beginning, rather than at the point where the playback of that recording was paused.

In still another variation, the initial "pause" command may be followed by such a "skip back" or similar command in response to a first predetermined period of time having elapsed since the user was determined to have stopped listening, and in the alternative, the initial "pause" command may be followed by a "stop" or "off" command in response to the elapsing of a second predetermined period of time since the user was determined to have stopped listening, where the second period of time is longer than the first. Yet other possible timed sequences of commands will occur to those skilled in the art.

In some embodiments, the circuit 150 is coupled to one or both of a control 175 and an indicator 176 providing a user interface by which the user may manually operate the audio output device 1000 and/or observe its operation. The control 175 may take the form of any of a wide variety of manually operable input devices, including and not limited to, a button, a lever switch, a touch sensor, a rotatable knob, or an orientation sensor. The indicator 176 may take the form of any of a wide variety of visually, audibly and/or tactilely perceivable devices, including and not limited to, a speech synthesizer, an alphanumeric display, a graphical display, a light-emitting diode, and a vibration device. Further, as those skilled in the art will readily recognize, the control 175 and the indicator 176 may be combined into a single device such as a touchscreen. Where the control 175 is present, the circuit 150 monitors the control 175 for indications of it being manually operated to provide the circuit 150 with input. Where the indicator 176 is present, the circuit 150 operates the indicator 176 to provide an indication of some form of information concerning the operation of the audio output device 1000 to the user.

In some embodiments incorporating one or both of the control 175 and the indicator 176, the control 175 and/or the indicator 176 may be operable to allow the user of the audio output device 1000 to choose what actions the circuit 150 takes in response to instances of determining that the user is no longer listening and/or in response to instances of determining that the user is once again listening. Among the selection of actions that the user may be allowed to choose for the circuit 150 to take may be a selection of what commands and/or sequences of commands to signal the audio source 900 with upon a determination that the user is no longer listening. Alternatively and/or additionally, the control 175 and/or the indicator 176 may be operable to enable the user to manually remotely control the audio source 900. In some embodiments, at least the control 175 may be provided to allow the user to specify a manufacturer, model, frequency, remote command set or other characteristic of the audio source 900 to thereby select protocols, timings, etc., by which the audio output device 1000 signals the audio source 900.

Any of a variety of mechanisms may be employed by the audio source 900 in providing a signal to the audio output device 1000 to convey audio, and any of a variety of mechanisms may be employed by the audio output device 1000 in signaling the audio source 900 with a command. In some embodiments, wired electrical connections are employed, perhaps with separate cables for conveying audio and for signaling commands. With wired electrical connections, the audio source 900 may convey audio to the audio output device 1000 as either one or more analog signals, or as serially transmitted digital data. In some embodiments, infrared or other forms of optical communication may be employed. With such optical transmission mechanisms, the audio source 900 may convey audio and/or the audio output device 1000 may convey commands in a frequency modulated beam of infrared light. In some embodiments, radio frequency signaling may be employed. With such radio frequency signaling, the audio source 900 and the audio output device 1000 may exchange audio and commands as digital data through a radio frequency based network formed between them. Further, various combinations of wired and wireless communications may be employed in still other possible embodiments.

In some embodiments, the circuit 150 is an analog circuit not employing digital signal processing. In other embodiments and as depicted in FIG. 1, the circuit 150 incorporates a storage 155 carrying a routine 157 and a processor 152 to read and execute a sequence of instructions making up the routine 157. In various embodiments, executing the routine 157 causes the processor 152 to employ any of a variety of the aforedescribed or other approaches to determine whether or not the user is listening. Additionally and/or alternatively, in various embodiments, the processor 152 is caused to respond to determinations of whether or not the user is listening in various ways, including and not limited to, turning on and/or off the amplifier 115, and signaling commands to the audio source 900 as has been described.

Figure 2:
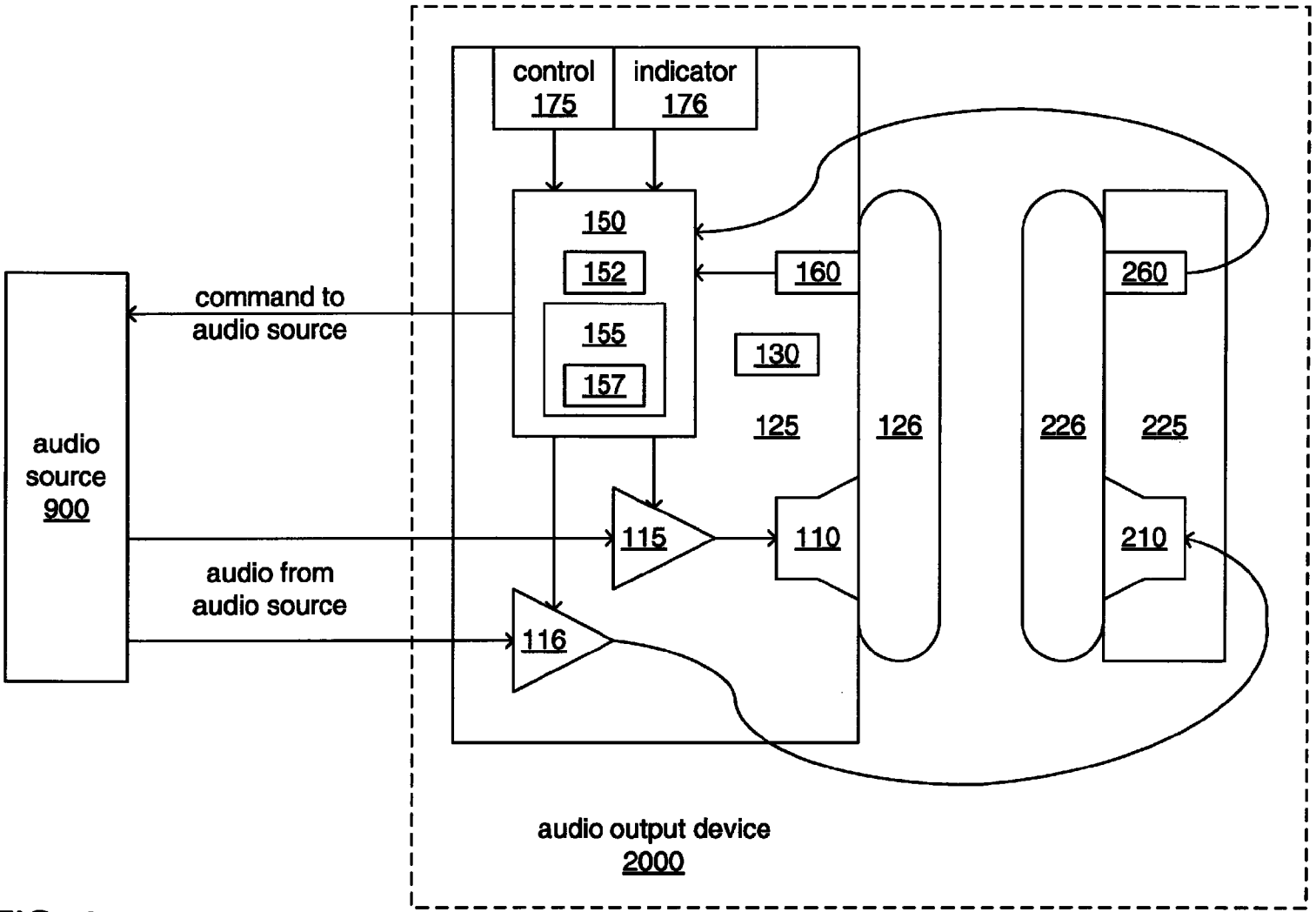
FIG. 2 is a block diagram of another audio output device.

FIG. 2 is a block diagram depicting a possible internal architecture of an audio output device 2000 for selectively audibly outputting audio to one or both ears of a user, and/or for selectively transmitting commands to an audio source 900 that may be supplying that audio. The audio output device 2000 of FIG. 2 is substantially similar in many respects to the audio output device 1000 of FIG. 1, with one substantial difference being that the audio output device 2000 is capable of providing audio to both ears of a user, instead of only one ear. Due to numerous substantial similarities between the audio output devices 1000 and 2000, corresponding elements have been designated with identical numerical labels.

The audio output device 2000 incorporates a pair of casings 125 and 225 that each have numerous similarities to the single casing 125 of the audio output device 1000. The casing 125 carries at least an acoustic driver 110, an ear coupling 126 and a sensor 160, and the casing 225 carries at least an acoustic driver 210, an ear coupling 226 and a sensor 260. One or the other of the casings 125 and 225 may further carry one or more of an amplifier 115, another amplifier 116, a power source 130, a circuit 150, a control 175 and an indicator 176. The ear couplings 126 and 226 may each take any of a variety of forms meant to guide each of the acoustic drivers 110 and 210, respectively, into close proximity with a corresponding ear of the user, including and not limited to, a flexible skirt meant to surround an earlobe, a flexible pad meant to be positioned to overlie an ear, or a tubular projection meant to be inserted into an ear canal. With the ear couplings 126 and 226 thereby each positioned around, against or at least partially within corresponding ones of the user's ears, the acoustic drivers 110 and 210 are able to audibly output audio into corresponding ears.

As previously stated, the audio that is output by the audio output device 2000 (through the acoustic drivers 110 and 210) may be provided to the audio output device 2000 by the audio source 900. The audio source 900 may be any of a number of devices capable of providing audio to the audio output device 2000, including and not limited to, a cell phone, a digital music file player (e.g., MP3 file player), a television, or an audio media player (e.g., a CD player). Additionally and/or alternatively, the audio that is output by the acoustic drivers 110 and 210 may be audio generated by the audio output device 2000 itself, perhaps by the circuit 150, as part of performing a noise reduction function.

As was the case with the audio output device 1000, in the audio output device 2000, the acoustic drivers 110 and 210, the power source 130, and the sensors 160 and 260 may each take any of a variety of forms and be based on any of a variety of technologies. Also, depending on the nature and the source of the audio output by the acoustic drivers 110 and 210, there may or may not be corresponding ones of the amplifiers 115 and 116 incorporated into the audio output device 1000 to amplify that audio and drive the acoustic drivers 110 and 210 with that audio.

In a manner not unlike the circuit 150 of the audio output device 1000, the sensors 160 and 260 are positioned within or are physically coupled to the ear couplings 126 and 226, respectively. Also, the circuit 150 of the audio output device 2000 employs the sensors 160 and 260 to determine whether or not the user is listening to the audio output device 2000 by determining whether or not the ear couplings 126 and 226 are positioned in close proximity to the user's ears. Further, the circuit 150 may respond to a determination that the user is or is not listening in any of a variety of ways. However, unlike the circuit 150 of the audio output device 1000, the circuit 150 of the audio output device 2000 also employs the sensors 160 and 260 to determine whether the user is listening to one or to both of the acoustic drivers 110 and 210, and the circuit 150 of the audio output device 2000 further determines which of the acoustic drivers 110 and 210 the user is listening to.

In some embodiments, the circuit 150 responds to the determination that the user is not listening to one or the other of the acoustic drivers 110 and 210 by turning off the corresponding one of the amplifiers 115 and 116, at least until the circuit 150 later determines that the user is once again listening to both of the acoustic drivers 110 and 210. In some embodiments, if the circuit 150 determines that the user is not listening to either of the acoustic drivers 110 and 210, the circuit 150 may turn off both of the amplifiers 115 and 116, again, at least until the circuit 150 later determines that the user is once again listening.

In some embodiments, the circuit 150 responds to the determination that the user is not listening to one or the other of the acoustic drivers 110 and 210 by signaling the audio source 900 with a command that in some way causes the audio source 900 to reroute one or more audio channels that were meant for the one of the acoustic drivers 110 and 210 to which the user is not listening to the other one of those acoustic drivers. By way of example, where the audio output device 2000 is worn on the user's head such that the acoustic driver 110 outputs a left audio channel to the user's left ear and the acoustic driver 210 outputs a right audio channel to the user's right ear, the circuit 150 responds to a determination that the user has ceased listening to the acoustic driver 110 be signaling the audio source 900 to combine the left and right audio channels and to provide that combination to the acoustic driver 210 such that the user hears both the left and right audio channels with the user's right ear. Further, the circuit 150 may also turn off the amplifier 115 to conserve power. Upon determining that the user is once again listening with both ears (i.e., listening to both of the acoustic drivers 110 and 210), the circuit 150 responds by signaling the audio source 900 to once again route the left audio channel to the acoustic driver 110 and the right channel audio to the acoustic driver 210.

Further, in such embodiments in which the circuit 150 signals the audio source 900 to reroute one or more audio channels, the circuit 150 may further signal the audio source 900 to discontinue providing a multitude of audio channels intended to convey surround sound audio the audio output device 1000. In other words, the circuit 150 may signal the audio source 900 to provide only left and right audio channels, and to provide only those two channels to whichever one of the acoustic drivers 110 and 210 that the user is determined to still be listening to. This may be done based on the presumption that the provision of surround sound audio to the audio output device 2000 is not useful unless the user is listening with both ears, since listening to surround sound audio with only one ear is unlikely to successfully result in the provision of the effect of surround sound to the user.

Any of a variety of mechanisms may be employed by the audio source 900 in providing a signal to the audio output device 1000 to convey audio, and by the audio output device 1000 in signaling the audio source 900 with a command. In some embodiments, wired electrical connections are employed, perhaps with separate cables for a signal conveying audio and for a signal conveying commands. With wired electrical connections, the audio source 900 may convey audio to the audio output device 2000 as either one or more analog signals, or as serially transmitted digital data. In some embodiments, infrared or other forms of optical communication may be employed. With such optical transmission mechanisms, the audio source 900 may convey audio and/or the audio output device 2000 may convey commands with frequency modulated infrared light (or other wavelengths of light) either through fiber optics or through open air. In some embodiments, radio frequency signaling may be employed. With such radio frequency signaling, the audio source 900 and the audio output device 2000 may exchange audio and commands as digital data through a radio frequency based digital network formed between them. Further, various combinations of wired and wireless communications may be employed in still other possible embodiments.

As those skilled in the art of the transfer of audio across various mediums will readily recognize, it is commonplace for the transfer of audio, whether through wired or wireless communications, to be carried out in a manner in which a device transmitting the audio in some way segregates or identifies differing audio channels such that the device receiving the audio is able to distinguish one audio channel from another. By way of example, in the case of widely used analog stereo audio connections, the left and right audio channels are conveyed using entirely separate conductors that are each dedicated to one of these two audio channels. Also by way of example, in the case of widely used pulse-code modulated digital audio conveyed either through a single coaxial electrical connection or a single optical fiber, up to 6 audio channels are conveyed in a digital serial transmission in which the different audio channels are identifiable by the timing of their transfer and/or serially-transmitted tags. Therefore, in these two examples, in signaling the audio source 900 to reroute one or more audio channels, the circuit 150 of the audio output device 2000 is signaling the audio output device 900 to combine one audio channel that would normally be sent on one conductor or with one identifying timing/tag with another audio channel normally sent on another conductor or with another identifying timing/tag.

In some embodiments, the circuit 150 may signal the audio source 900 with any of a wide variety of commands or sequences of commands chosen to cause the audio source 900 to at least momentarily cease providing audio to the audio output device 2000 in response to a determination that the user is not listening to the audio output device 2000, at all. In some embodiments, the circuit 150 may simply signal the audio source 900 with a "stop" command or a "pause" command to cause the audio source 900 to cease providing audio. This may be deemed appropriate where the audio source 900 is engaged in playing an audio recording, such as where the audio source 900 is a compact disc player or digital music file player (e.g., MP3 player). It may be deemed preferable for the circuit 150 to at least initially signal the audio source 900 with a "pause" command and later signal the audio source to cease obeying the "pause" command in response to a determination that the user is once again listening. In this way, the user, while listening to audio provided by the audio source 900 through the acoustic driver 110 of the audio output device 2000, may simply remove the audio output device 2000 such that the ear couplings 126 and 226 are no longer in close proximity to the user's ears, and the circuit 150 will automatically respond by signaling the audio source 900 to pause its audio output. Then, when the user once again puts the audio output device 2000 in place such that the ear couplings 126 and 226 are once again in close proximity to the user's ears, the circuit 150 will automatically respond by signaling the audio source 900 to resume its output. This enhances ease of use by causing the combination of the audio output device 2000 and the audio source 900 to interact to better respond to the actions of the user, rather than requiring the user to consciously control either of the audio output device 2000 or the audio source 900.

In some embodiments, the initial "pause" command signaled to the audio source 900 in response to a determination that the user is not listening may be followed by one or more subsequent commands after at least one predetermined interval of time has passed from the time at which the determination was made that the user is not listening (and where there has not yet been a determination made that the user is once again listening). In one variation, the initial "pause" command may be followed by a "stop" command and/or an "off" command to the audio source 900 after another predetermined period of time has elapsed based on a presumption that it is now less likely that the user will resume within a short period of time, and therefore, it is desirable to operate the audio source 900 to conserve power. As those skilled in the art will recognize, some possible forms of the audio source 900 consume more power while obeying a "pause" command than while obeying a "stop" command. For example, some disk media players continue to operate a motor to rotate a disk when obeying a "pause" command, but cease to do when obeying a "stop" command. However, as those skilled in the art will also recognize, with many possible forms of the audio source 900, unlike a "pause" command that allows playback of a recording to be resumed from the point at which the "pause" command was signaled, it is typical that the signaling of a "stop" or "off" command at that same point results in there being no way to resume playback of that recording from that point. Therefore, it may be deemed desirable to signal a "pause" command, at first, so that the user may easily return to listening at the point where the user was determined to have stopped listening, and to only signal a "stop" or "off" command to conserve power after a predetermined period of time when it is presumed that the user will not be returning to listening for some time to come, as it is also likely that the user will no longer remember exactly what the user was listening to.

In another variation of such embodiments, the initial "pause" command may be followed by a subsequent "track -" or similar command in response to an additional predetermined period of time having elapsed since the user was determined to have stopped listening and the "pause" command was sent. This may be deemed desirable where the audio source 900 is outputting a sequence or list of audio recordings, and the user was determined to have stopped listening in the middle of the playback of one of those recordings. This may be done on the presumption that after a relatively longer period of time of not listening to the playback of that recording, the user will likely prefer to resume listening to that recording from the beginning, rather than at the point where the playback of that recording was paused. Further, as those skilled in the art will readily recognize, some of the possible forms of the audio source 900 consume less power upon having playback halted or "paused" at a point at the beginning of an audio recording or discretely stored portion of an audio recording, than upon having playback halted or "paused" amidst that recording.

In still another variation, the initial "pause" command may be followed by such a "track -" or similar command in response to a first predetermined period of time having elapsed since the user was determined to have stopped listening, and in the alternative, the initial "pause" command may be followed by a "stop" or "off" command in response to the elapsing of a second predetermined period of time since the user was determined to have stopped listening, where the second period of time is longer than the first. Yet other possible timed sequences of commands will occur to those skilled in the art.

In some embodiments, the circuit 150 is coupled to one or both of the control 175 and the indicator 176 providing a user interface by which the user may manually operate the audio output device 2000 and/or observe its operation. The control 175 may take the form of any of a wide variety of manually operable input devices, including and not limited to, a button, a lever switch, a touch sensor, a rotatable knob, or an orientation sensor. The indicator 176 may take the form of any of a wide variety of visually, audibly and/or tactilely perceivable devices, including and not limited to, a speech synthesizer, an alphanumeric display, a graphical display, a light-emitting diode, and a vibration device. Further, as those skilled in the art will readily recognize, the control 175 and the indicator 176 may be combined into a single device such as a touchscreen. Where the control 175 is present, the circuit 150 monitors the control 175 for indications of it being manually operated to provide the circuit 150 with input. Where the indicator 176 is present, the circuit 150 operates the indicator 176 to provide an indication of some form of information concerning the operation of the audio output device 2000 to the user.

In some embodiments incorporating one or both of the control 175 and the indicator 176, the control 175 and/or the indicator 176 may be operable to allow the user of the audio output device 2000 to choose what actions the circuit 150 takes in response to instances of determining that the user is no longer listening and/or in response to instances of determining that the user is once again listening. Further, the control 175 and/or the indicator 176 may be operable to allow the user of the audio output device 2000 to choose what actions the circuit 150 takes in response to instances of determining that the user is listening to only one of the acoustic drivers 110 and 210, but not both. Among the selection of actions that the user may be allowed to choose for the circuit 150 to take may be a selection of what commands and/or sequences of commands to signal the audio source 900 with in response to a determination that the user is no longer listening or that the user is listening with only one ear. Alternatively and/or additionally, the control 175 and/or the indicator 176 may be operable to enable the user to manually remotely control the audio source 900. In some embodiments, at least the control 175 may be provided to allow the user to specify a manufacturer, model, frequency, remote command set or other characteristic of the audio source 900 to thereby select protocols, timings, etc., by which the audio output device 2000 signals the audio source 900.

In some embodiments, the circuit 150 is an analog circuit not employing digital signal processing. In other embodiments and as depicted in FIG. 1, the circuit 150 incorporates a storage 155 carrying a routine 157 and a processor 152 to read and execute a sequence of instructions making up the routine 157. In various embodiments, executing the routine 157 causes the processor 152 to employ any of a variety of the aforedescribed or other approaches to determine whether or not the user is listening. Additionally and/or alternatively, in various embodiments, the processor 152 is caused to respond to determinations of whether or not the user is listening in various ways, including and not limited to, turning on and/or off one or both of the amplifiers 115 and 116, and signaling commands to the audio source 900 as has been described.

Figure 3:
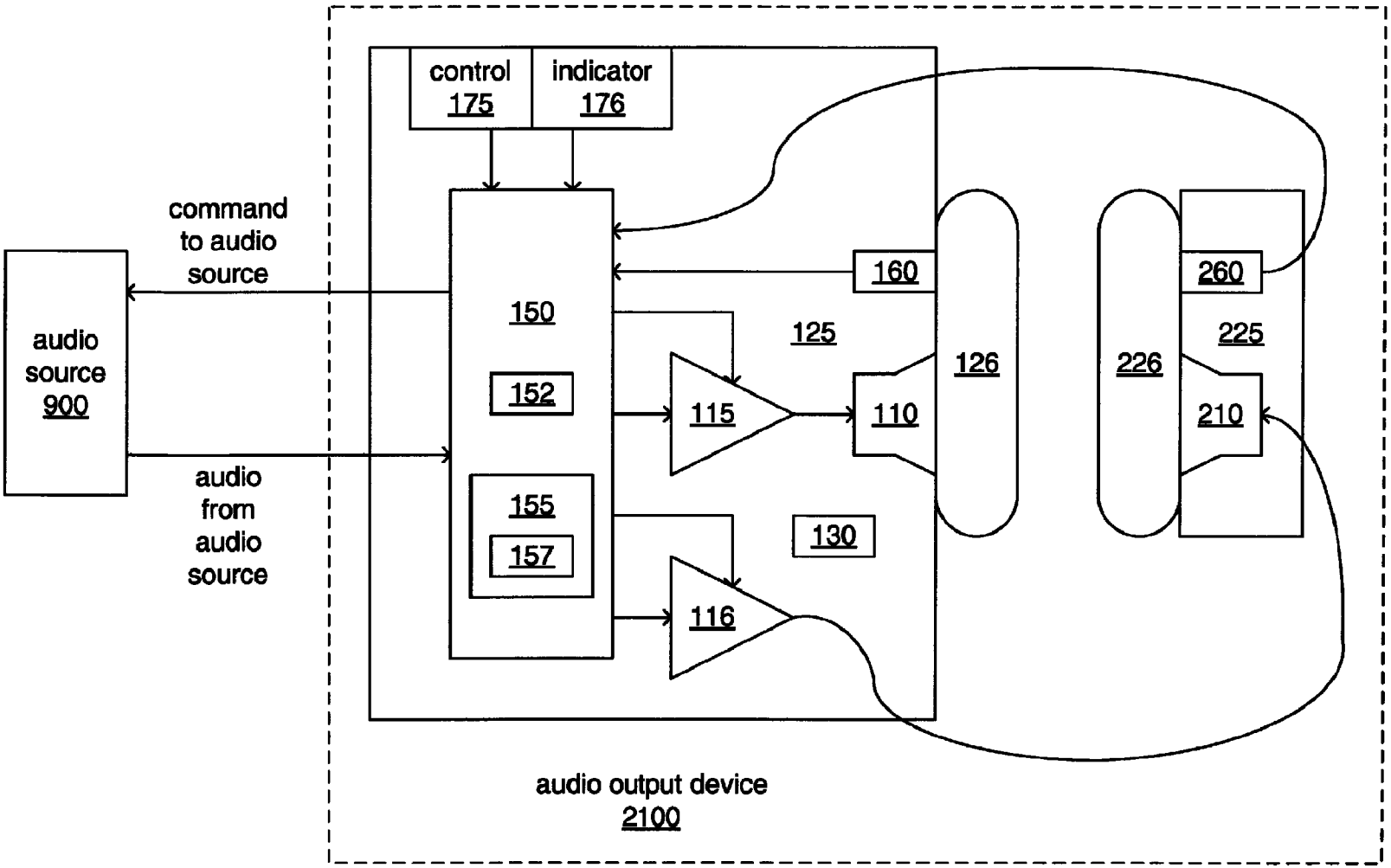
FIG. 3 is a block diagram of still another audio output device.

FIG. 3 is a block diagram depicting a possible internal architecture of an audio output device 2100 for selectively audibly outputting audio to one or both ears of a user, and/or for selectively transmitting commands to an audio source 900 that may be supplying that audio. The audio output device 2100 of FIG. 3 is substantially similar in many respects to the audio output device 2000 of FIG. 2, with one substantial difference being that the audio output device 2100 is structured to receive and perform signal processing on audio received from the audio source 900 exclusively in digital form. Due to numerous substantial similarities between the audio output devices 2000 and 2100, corresponding elements have been designated with identical numerical labels.

Like the audio output device 2000, the audio output device 2100 incorporates a pair of casings 125 and 225. Also, what is or what may be carried by each of the casings 125 and 225 is substantially similar to what has already been discussed with regard to audio output device 2000. However, unlike the audio device 2000 in which audio received from the audio source 900 was relatively directly provided to the amplifiers 115 and 116, audio received from the audio source 900 proceeds through the circuit 150 before being provided to the amplifiers 115 and 116. In this way, the circuit 150 is able to decode the various audio channels received in digital form from the audio source 900 before passing on the decoded channels to corresponding ones of the amplifiers 115 and 116. Further, in this way, in some embodiments, the circuit 150 is able to perform one or more forms of digital signal processing on the audio received from the audio source 900.

As was the case with the audio output device 2000, the ear couplings 126 and 226 of the audio output device 2100 may each take any of a variety of forms meant to guide each of the acoustic drivers 110 and 210, respectively, into close proximity with a corresponding ear of the user. As was also the case with the audio output device 2000, in the audio output device 2100, the acoustic drivers 110 and 210, the power source 130, and the sensors 160 and 260 may each take any of a variety of forms and be based on any of a variety of technologies. Further, the sensors 160 and 260 are positioned within or are physically coupled to the ear couplings 126 and 226, respectively, and are employed by the circuit 150 to determine whether or not the user is listening, and with which ears.

In the audio output device 2100, the possible actions that the circuit 150 may take in response to determinations that the user is not listening, determinations of which ear (and therefore, which of the acoustic drivers 110 and 210) the user is listening with, and determinations that the user is once again listening are largely similar to those discussed with regard to the audio output device 2000. In various embodiments, the audio output device 2100 may signal the audio source 900 with commands to cause the audio source 900 to cease and/or resume providing audio to the audio output device 2100, as well as on which audio channels, and the signaling of these commands may be chosen and may be signaled with various possible timings depending on the amount of time that elapses from the time at which the user is determined to not be listening or is determined to be listening with only one ear. Also, in various embodiments, the audio output device 2100 may turn off one or both of the amplifiers 115 and 116, as well as take other actions to conserve power in response to either a determination that the user is no longer listening or that the user is not listening with both ears. Further, in various embodiments, the user may be provided with the ability to control what actions the circuit 150 takes through operation of one or both of a control 175 and an indicator 176.

As previously mentioned, in the audio output device 2100, the audio is received more directly by the circuit 150 from the audio source 900, and as digital audio data, thereby enabling the circuit 150 to more directly perform one or more forms of digital signal processing on that audio before it is output. In some embodiments, the circuit 150 is capable of directly performing the rerouting of one or more audio channels in response to a determination that the user is listening with only one ear in lieu of signaling the audio source 900 with one or more commands to perform such rerouting. In some embodiments, the circuit 150 may be capable of receiving audio from the audio source 900 as stereo audio having only left and right audio channels, and processing that 2-channel audio to create a simulated form of surround sound audio to be output by the audio output device 2100. Where the audio output device 2100 is capable of providing such simulated surround sound, the circuit 150 may further respond to a determination that the user is listening with only one ear by ceasing the creation of simulated surround sound audio, as it is unlikely that the user would be able to experience the full effect with only one ear.

Figure 4:
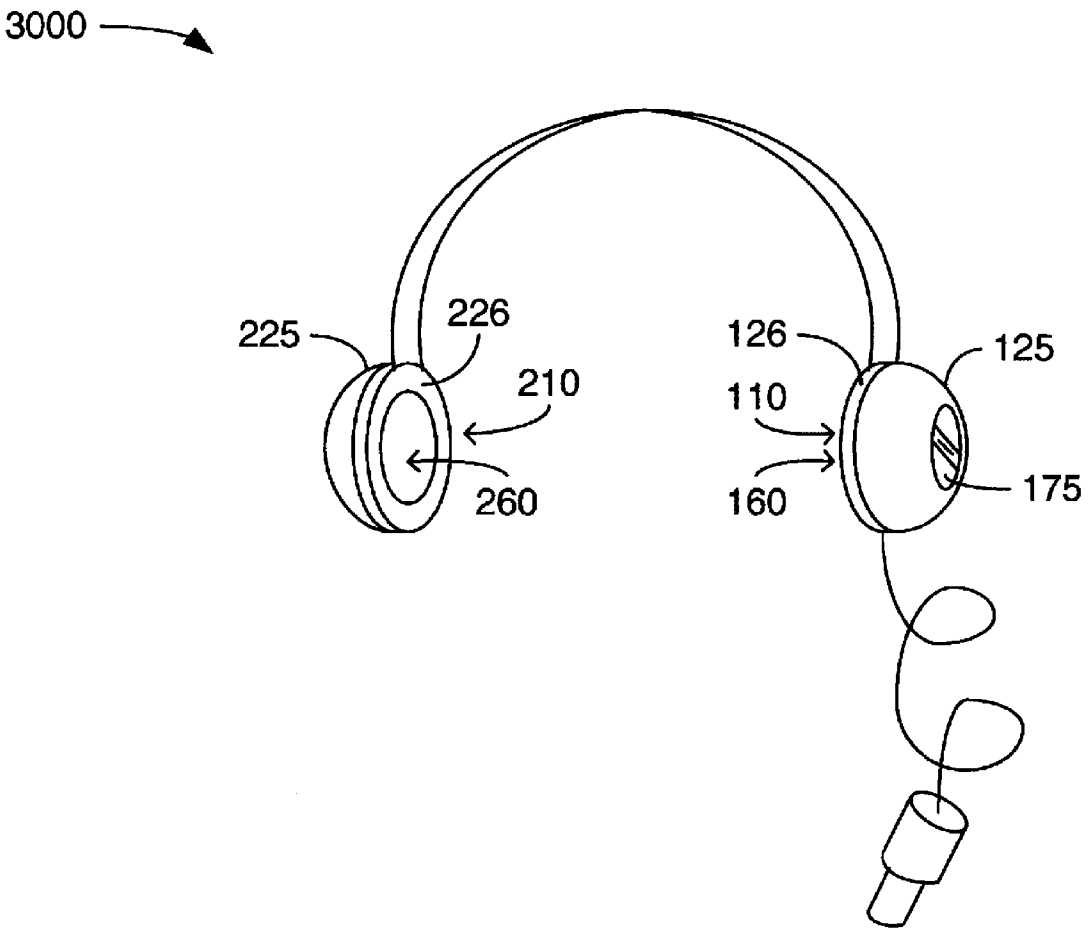
FIG. 4 is a perspective view of an audio output device.
Figure 5:
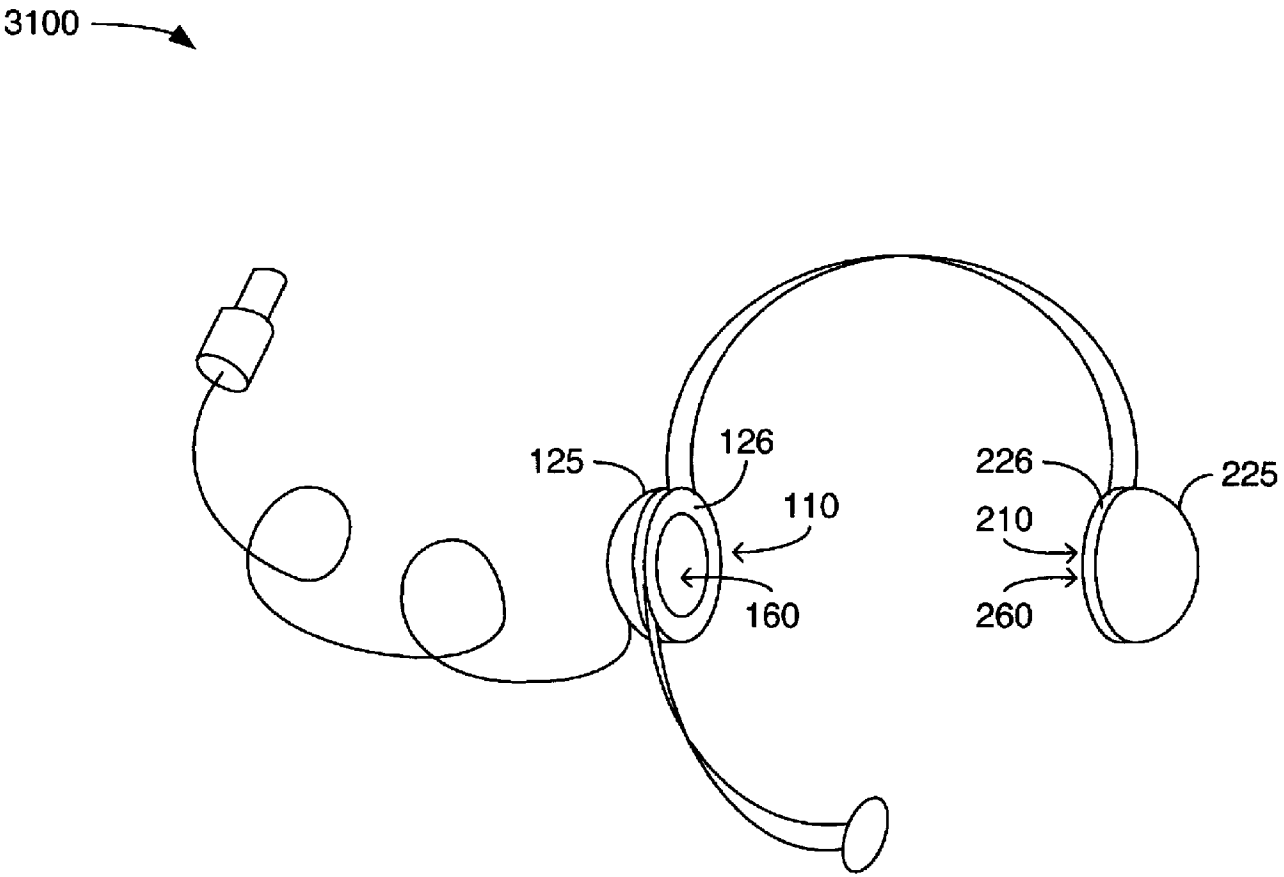
FIG. 5 is a perspective view of another audio output device.
Figure 6:
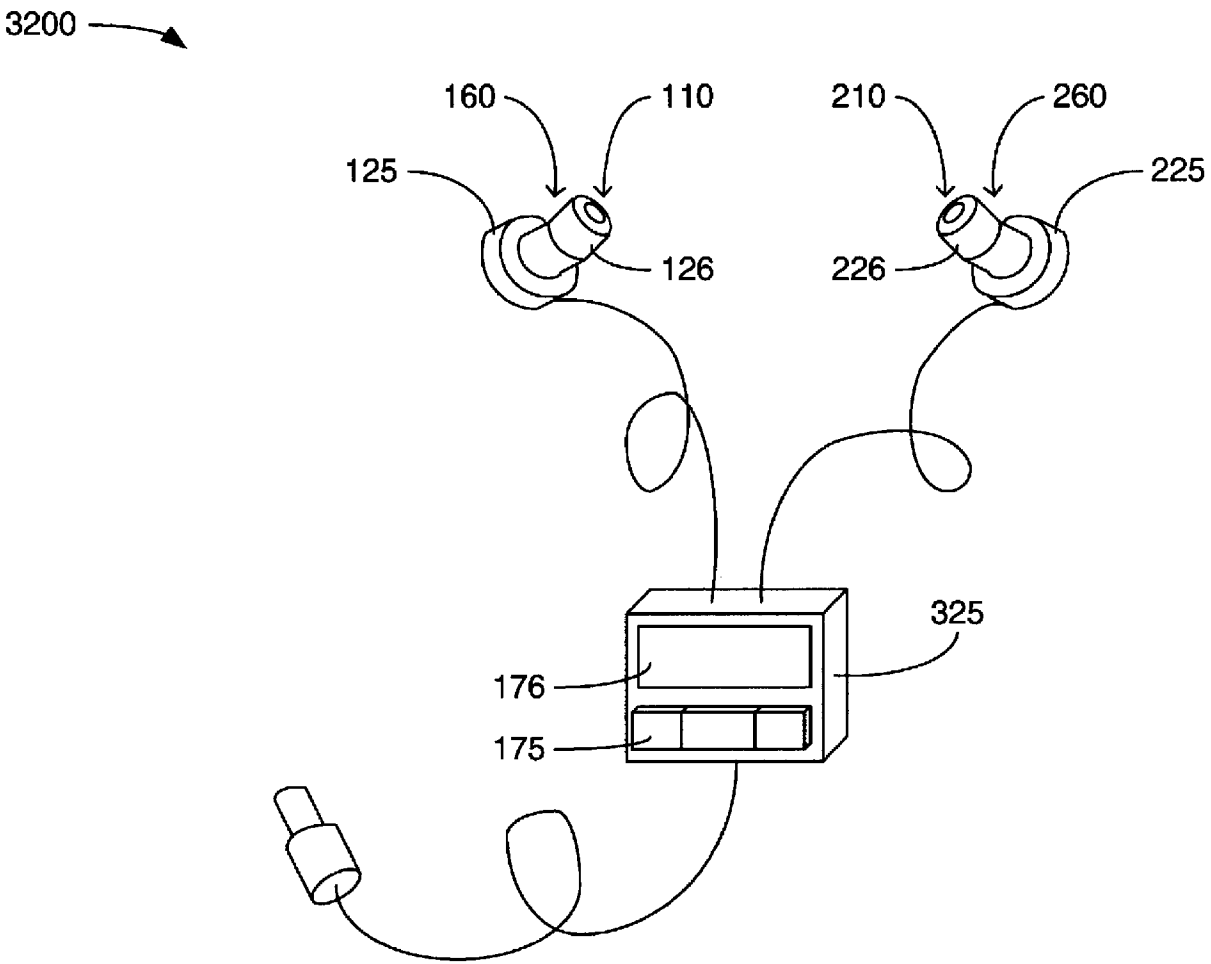
FIG. 6 is a perspective view of still another audio output device.

FIGS. 4, 5 and 6 are perspective diagrams of possible physical configurations of audio output devices 3000, 3100 and 3200, respectively. Each of the depicted audio output devices 3000, 3100 and 3200 may be based on one of the internal architectures previously disclosed, or any of a number of possible variations of those internal architectures. Given this, a number of corresponding elements have been labeled with numerical designations that are identical between the audio output devices 3000, 3100 and 3200 depicted in FIGS. 4-6, and the audio output devices 1000, 2000 and 2100 depicted in FIGS. 1-3. The audio output devices 3000, 3100 and 3200 each incorporate a pair of casings 125 and 225 that together carry at least a pair of acoustic drivers 110 and 210, and a pair of ear couplings 126 and 226.

As depicted, the audio output device 3000 is in the form of what is commonly referred to as a pair of headphones, and the casings 125 and 225, together with the ear couplings 126 and 226, respectively, form what are commonly referred to as the earcups. Depending on the size of the ear couplings 126 and 226 relative to a typical human earlobe, the audio output device 3000 may be described as either "on-ear" headphones in which each of the ear couplings 126 and 226 overlie an ear when the worn on a human head, or as "over-the-ear" headphones in which each of the ear couplings 126 and 226 surround an earlobe and come into contact with portions of a human head surrounding the earlobes. As has been discussed at length, the pair of sensors 160 and 260 are either incorporated into the ear couplings 126 and 226 or are otherwise positioned in relation to the ear couplings 126 and 226 so that each of the sensors 160 and 260 are able to detect indications of whether or not corresponding ones of the ear couplings 126 and 226 are positioned in close proximity to each ear of a user. Further, as is also depicted, the casing 125 carries a control 175 that, in some embodiments, allows the user of the audio output device 3000 to select from among a variety of possible responses to determinations of whether or not the user is listening to the audio output device 3000, and with which ears.

As depicted, the audio output device 3100 is in the form of what is commonly referred to as a headset with the casings 125 and 225 again each having the form of an earcup. Depending on the size of the ear couplings 126 and 226 relative to a typical human earlobe, the audio output device 3100 may be described as either an on-ear headset or an over-the-ear headset. As also depicted, the audio output device 3100 further incorporates a boom microphone to enable a two-way exchange of audio with an audio source (not shown).

As depicted, the audio output device 3200 is in the form of what is commonly referred to as a pair of earbuds (or in-ear headphones) with the casings 125 and 225 each having the form of an earbud. Each of the ear couplings 126 and 226 is of a form meant to facilitate insertion into an ear canal, rather than overlying or surrounding an earlobe as in the cases of the audio output devices 3000 and 3100. As also depicted, the audio output device 3200 incorporates a third casing 325 carrying at least a control 175 and an indicator 176 to provide the user of the audio output device 3200 with a user interface that may allow the user to select from among a variety of possible responses to determinations of whether or not the user is listening to the audio output device 3000, and with which ears.

It should be noted that although the audio output devices 3000, 3100 and 3200 have each been depicted as being wired devices having cords by which each may be physically connected to an audio source, this need not be the case. More specifically, those skilled in the art will readily recognize that any of the above-described audio output devices may be implemented in wireless form by which, at a minimum, audio to be output by one or more acoustic drivers is received wirelessly from an audio source, and by which any signaling of the audio source with commands may be performed. As those skilled in the art will further recognize, any of a variety of wireless technologies may be employed, including and not limited to, radio frequency, infrared, and ultrasonic transmissions.

Other embodiments are within the scope of the following claims.

What is claimed is:

1. An apparatus structured to be worn on the head of a user to audibly output a sequence of pieces of audio conveyed to the apparatus by a remote audio source, the apparatus comprising:

a first acoustic driver;

a first ear coupling structured to be positioned in close proximity to a first ear of the user to position the first acoustic driver to audibly output a first portion of a single piece of audio of the sequence of pieces of audio to the first ear;

a first sensor positioned relative to the first ear coupling to detect whether or not the first ear coupling is positioned in close proximity to the first ear; and a circuit coupled to the first sensor to monitor the first sensor, and structured to:

in response to receiving from at least the first sensor an indication of at least the first ear coupling not being positioned in close proximity to the first ear, signal the audio source with a first command to cease playing the single piece of audio in a manner that enables playing of the single piece of audio to be resumed at a point at which the single piece of audio ceases to be played by the audio source in response to being signaled with the first command;

in response to receiving from at least the first sensor an indication of at least the first ear coupling again being positioned in close proximity to the first ear within a first predetermined period of time after receiving the indication of at least the first ear coupling not being positioned in close proximity to the first ear, signal the audio source with a second command to resume playing the single piece of audio starting at the point at which the single piece of audio ceased to be played by the audio source in response to being signaled with the first command; and in response to not receiving from at least the first sensor an indication of at least the first ear coupling again being positioned in close proximity to the first ear within the first predetermined period of time, signal the audio source with a third command to prepare to resume playing the single piece of audio starting at the beginning of the single piece of audio.

2. The apparatus of claim 1, further comprising:

a second acoustic driver;

a second ear coupling structured to be positioned in close proximity to a second ear of the user to position the second acoustic driver to audibly output a second portion of the single piece of audio to the second ear; and a second sensor coupled to the circuit to be monitored by the circuit and positioned relative to the second ear coupling to detect whether or not the second ear coupling is positioned in close proximity to the second ear; and wherein the circuit is further structured to:

signal the audio source with the first command in response to receiving from the first and second sensors an indication of the first ear coupling not being positioned in close proximity to the first ear and the second ear coupling not being positioned in close proximity to the second ear;

signal the audio source with the second command in response to receiving from the first and second sensors an indication of at least one of the first ear coupling again being positioned in close proximity to the first ear and the second ear coupling again being positioned in close proximity to the second ear within the first predetermined period of time after receiving the indication of the first ear coupling not being positioned in close proximity to the first ear and the second ear coupling not being positioned in close proximity to the second ear; and signal the audio source with the third command in response to not receiving from the first sensor an indication of the first ear coupling again being positioned in close proximity to the first ear and not receiving from the second sensor an indication of the second ear coupling again being positioned in close proximity to the second ear within the first predetermined period of time.

3. The apparatus of claim 1, wherein the circuit is further structured to:

signal the audio source with a fourth command to resume playing the single piece of audio starting at the beginning of the single piece of audio in response to receiving from at least the first sensor an indication of at least the first ear coupling again being positioned in close proximity to the first ear after the first predetermined period has elapsed and within a second predetermined period of time from receiving the indication of at least the first ear coupling not being positioned in close proximity to the first ear, wherein the second predetermined period of time is longer than the first predetermined period of time; and signal the audio source with a fifth command to cease being prepared to resume playing the single piece of audio starting either at the point at which the single piece of audio ceased to be played by the audio source in response to being signaled with the first command or at the beginning of the single piece of audio in response to not receiving from at least the first sensor an indication of the at least the first ear coupling again being positioned in close proximity to the first ear after the second predetermined period has elapsed.

4. The apparatus of claim 3, wherein the first command comprises a command to pause playing audio and the fifth command comprises a command to stop playing audio.

5. The apparatus of claim 3, wherein the first command comprises a command to pause playing audio and the fifth command comprises a command to cause the audio source to be turned off.

6. The apparatus of claim 3, wherein the third and fourth commands are one and the same command to resume playing the piece of audio starting at the beginning of the single piece of audio.

7. An apparatus structured to be worn on the head of a user to audibly output a piece of audio conveyed to the apparatus by a remote audio source, the apparatus comprising:

a first acoustic driver;

a first ear coupling structured to be positioned in close proximity to a first ear of the user to position the first acoustic driver to audibly output a first portion of the piece of audio to the first ear;

a first sensor positioned relative to the first ear coupling to detect whether or not the first ear coupling is positioned in close proximity to the first ear;

a second acoustic driver;

a second ear coupling structured to be positioned in close proximity to a second ear of the user to position the second acoustic driver to audibly output a second portion of the piece of audio to the second ear; and a second sensor positioned relative to the second ear coupling to detect whether or not the second ear coupling is positioned in close proximity to the second ear; and a circuit coupled to the first and second sensors to monitor the first and second sensors, and structured to:

signal the audio source with at least one command to cause the audio source to cease providing at least a third portion of the piece of audio to the apparatus while still providing the first and second portions of the piece of audio to the apparatus in response to receiving indications from the first and second sensors that the first ear coupling is in close proximity to the first ear and the second ear coupling is not in close proximity to the second ear, wherein conveying a combination of the first portion of the piece of audio, the second portion of the piece of audio and the at least a third portion of the piece of audio to the apparatus conveys surround sound to the apparatus.

8. The apparatus of claim 7, wherein:

the audio source derives the third portion of the piece of audio as part of providing a simulation of surround sound; and the at least one command comprises a command to cause the audio source to cease providing a simulation of surround sound.

9. The apparatus of claim 7, wherein the circuit is further structured to redirect the second portion of the piece of audio away from the second acoustic driver and to the first acoustic driver in combination with the first portion of the piece of audio in response to receiving indications from the first and second sensors that the first ear coupling is in close proximity to the first ear and the second ear coupling is not in close proximity to the second ear.

10. The apparatus of claim 7, further comprising an audio amplifier to drive the second acoustic driver, wherein the circuit is further structured to turn off the audio amplifier in response to receiving indications from the first and second sensors that the first ear coupling is in close proximity to the first ear and the second ear coupling is not in close proximity to the second ear.

11. The apparatus of claim 7, wherein the circuit is further structured to:

provide ANR to the second ear by causing the second acoustic driver to acoustically output anti-noise sounds; and cease providing ANR to the second ear in response to receiving indications from the first and second sensors that the first ear coupling is in close proximity to the first ear and the second ear coupling is not in close proximity to the second ear.

12. A method of automatically remotely controlling an audio source remotely conveying a sequence of pieces of audio to an apparatus structured to be worn on the head of a user to audibly output the sequence of pieces of audio to the user, the method comprising:

monitoring a first sensor of the apparatus for indications of whether or not a first ear coupling of the apparatus is positioned in close proximity to a first ear of the user such that a first acoustic driver of the apparatus is positioned to audibly output a first portion of a single piece of audio of the sequence of pieces of audio to the first ear;

in response to receiving from at least the first sensor an indication of at least the first ear coupling not being positioned in close proximity to the first ear, signaling the audio source with a first command to cease playing the single piece of audio in a manner that enables playing of the single piece of audio to be resumed at a point at which the single piece of audio ceases to be played by the audio source in response to being signaled with the first command;

in response to receiving from at least the first sensor an indication of at least the first ear coupling again being positioned in close proximity to the first ear within a first predetermined period of time after receiving the indication of at least the first ear coupling not being positioned in close proximity to the first ear, signaling the audio source with a second command to resume playing the single piece of audio starting at the point at which the single piece of audio ceased to be played by the audio source in response to being signaled with the first command; and in response to not receiving from at least the first sensor an indication of at least the first ear coupling again being positioned in close proximity to the first ear within the first predetermined period of time, signaling the audio source with a third command to prepare to resume playing the single piece of audio starting at the beginning of the single piece of audio.

13. The method of claim 12, further comprising:

monitoring a second sensor of the apparatus for indications of whether or not a second ear coupling of the apparatus is positioned in close proximity to a second ear of the user such that a second acoustic driver of the apparatus is positioned to audibly output a second portion of the single piece of audio to the second ear;

signaling the audio source with the first command in response to receiving from the first and second sensors an indication of the first ear coupling not being positioned in close proximity to the first ear and the second ear coupling not being positioned in close proximity to the second ear;

signaling the audio source with the second command in response to receiving from the first and second sensors an indication of at least one of the first ear coupling again being positioned in close proximity to the first ear and the second ear coupling again being positioned in close proximity to the second ear within the first predetermined period of time after receiving the indication of the first ear coupling not being positioned in close proximity to the first ear and the second ear coupling not being positioned in close proximity to the second ear; and signaling the audio source with the third command in response to not receiving from the first sensor an indication of the first ear coupling again being positioned in close proximity to the first ear and not receiving from the second sensor an indication of the second ear coupling again being positioned in close proximity to the second ear within the first predetermined period of time.

14. The method of claim 12, further comprising:

signaling the audio source with a fourth command to resume playing the single piece of audio starting at the beginning of the single piece of audio in response to receiving from at least the first sensor an indication of at least the first ear coupling again being positioned in close proximity to the first ear after the first predetermined period has elapsed and within a second predetermined period of time from receiving the indication of at least the first ear coupling not being positioned in close proximity to the first ear, wherein the second predetermined period of time is longer than the first predetermined period of time; and signaling the audio source with a fifth command to cease being prepared to resume playing the single piece of audio starting either at the point at which the single piece of audio ceased to be played by the audio source in response to being signaled with the first command or at the beginning of the single piece of audio in response to not receiving from at least the first sensor an indication of the at least the first ear coupling again being positioned in close proximity to the first ear after the second predetermined period of time has elapsed.

15. The method of claim 14, wherein the first command comprises a command to pause playing audio and the fifth command comprises a command to stop playing audio.

16. The method of claim 14, wherein the first command comprises a command to pause playing audio and the fifth command comprises a command to cause the audio source to be turned off.

17. The method of claim 14, wherein the third and fourth commands are one and the same command to resume playing the piece of audio starting at the beginning of the single piece of audio.

18. A method of automatically remotely controlling an audio source remotely conveying a piece of audio to an apparatus structured to be worn on the head of a user to audibly output the piece of audio to the user, the method comprising:

monitoring a first sensor of the apparatus for indications of whether or not a first ear coupling of the apparatus is positioned in close proximity to a first ear of the user such that a first acoustic driver of the apparatus is positioned to audibly output a first portion of the piece of audio to the first ear;

monitoring a second sensor of the apparatus for indications of whether or not a second ear coupling of the apparatus is positioned in close proximity to a second ear of the user such that a second acoustic driver of the apparatus is positioned to audibly output a second portion of the piece of audio to the second ear; and signaling the audio source with at least one command to cause the audio source to cease providing at least a third portion of the piece of audio to the apparatus while still providing the first and second portions of the piece of audio to the apparatus in response to receiving indications from the first and second sensors that the first ear coupling is in close proximity to the first ear and the second ear coupling is not in close proximity to the second ear, wherein conveying a combination of the first portion of the piece of audio, the second portion of the piece of audio and the at least a third portion of the piece of audio to the apparatus conveys surround sound to the apparatus.

19. The method of claim 18, wherein:

the audio source derives the third portion of the piece of audio as part of providing a simulation of surround sound; and signaling the audio source with the at least one command comprises signaling the audio source with a command to cause the audio source to cease providing a simulation of surround sound.

20. The method of claim 18, further comprising redirecting the second portion of the piece of audio away from the second acoustic driver and to the first acoustic driver in combination with the first portion of the piece of audio in response to receiving indications from the first and second sensors that the first ear coupling is in close proximity to the first ear and the second ear coupling is not in close proximity to the second ear.

21. The method of claim 18, further comprising turning off an audio amplifier coupled to the second acoustic driver in response to receiving indications from the first and second sensors that the first ear coupling is in close proximity to the first ear and the second ear coupling is not in close proximity to the second ear.

22. The method of claim 18, further comprising:

providing ANR to the second ear by causing the second acoustic driver to acoustically output anti-noise sounds; and ceasing to provide ANR to the second ear in response to receiving indications from the first and second sensors that the first ear coupling is in close proximity to the first ear and the second ear coupling is not in close proximity to the second ear.

* * * * *